US008499944B2

(12) United States Patent
Parks et al.

(10) Patent No.: US 8,499,944 B2
(45) Date of Patent: Aug. 6, 2013

(54) BAKING STONE RACK

(75) Inventors: Cecilia Munson Parks, Hendersonville, TN (US); Daniel Hartly Green, Nashville, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 578 days.

(21) Appl. No.: 12/633,986

(22) Filed: Dec. 9, 2009

(65) Prior Publication Data

US 2010/0084355 A1 Apr. 8, 2010

Related U.S. Application Data

(63) Continuation of application No. 11/466,514, filed on Aug. 23, 2006, now abandoned.

(51) Int. Cl.
*F24C 15/16* (2006.01)
*A47F 5/08* (2006.01)

(52) U.S. Cl.
USPC ..... 211/153; 126/339

(58) Field of Classification Search
USPC ..... 211/41.4, 85.31, 90.03, 106, 112, 211/119, 126.8, 126.9, 133.2, 133.5, 134, 211/153, 181.1; 126/332, 337 R, 339, 340
See application file for complete search history.

(56) References Cited

U.S. PATENT DOCUMENTS

| | | | | |
|---|---|---|---|---|
| 363,281 | A | | 5/1887 | Bussey |
| 393,652 | A | | 11/1888 | McLane |
| 446,855 | A | | 2/1891 | Earle |
| 803,102 | A | | 10/1905 | Harris |
| 812,158 | A | | 2/1906 | Tuttle |
| 825,631 | A | | 7/1906 | Agnew |
| 857,724 | A | | 6/1907 | Dean |
| 878,434 | A | | 2/1908 | Van Houten |
| 1,004,996 | A | | 10/1911 | Collins |
| 1,035,587 | A | * | 8/1912 | Hoffman ..... 126/332 |
| 1,206,730 | A | | 11/1916 | Rideout |
| 1,317,674 | A | | 10/1919 | Alexander |
| 1,389,908 | A | | 9/1921 | Shults et al. |
| 1,800,052 | A | | 8/1929 | Brumbaugh |
| 1,748,854 | A | * | 2/1930 | Stockstrom ..... 126/339 |
| 2,033,792 | A | | 10/1930 | Sywert |
| 2,008,315 | A | | 7/1931 | Schmidt |
| 1,997,432 | A | | 2/1932 | Replogle |

(Continued)

FOREIGN PATENT DOCUMENTS

| | | | |
|---|---|---|---|
| DE | 9013341 | | 11/1990 |
| EP | 623303 | A1 * | 11/1994 |
| EP | 1415581 | | 5/2004 |

*Primary Examiner* — Jonathan Liu
*Assistant Examiner* — Joshua Rodden
(74) *Attorney, Agent, or Firm* — Pearne & Gordon LLP

(57) ABSTRACT

A rack for an appliance comprises a main section including a support frame having a front wire, rear wire, and opposed side wires. A plurality of intermediate wires are attached to the support frame and at least one cross member is provided across a portion of the intermediate wires. The rack also includes a recessed section defined by a portion of the intermediate wires and for removeably receiving a baking stone. In one example, the recessed section has a depth sufficient to accommodate a baking stone substantially completely therein. In addition or alternatively, an arrangement for supporting items within an appliance includes a rack having a main section and a recessed section, and a baking stone which can be received substantially completely within the recessed section of the rack.

4 Claims, 7 Drawing Sheets

U.S. PATENT DOCUMENTS 1,995,399 A 8/1932 Reedy et al.
2,002,339 A 12/1933 Copeman
2,014,346 A 1/1934 Thomas
2,095,811 A 3/1934 Goulooze
2,078,681 A 3/1935 Otte
2,074,785 A 7/1935 Gentz
2,168,172 A 9/1936 Rees
2,089,359 A * 8/1937 Goulooze ..... 108/26
2,146,199 A 6/1938 Barnhardt
2,524,900 A 5/1947 Fannie
2,633,400 A 2/1950 Ring
2,626,773 A 9/1950 Backman
2,564,473 A * 8/1951 Ferguson ..... 312/408
2,885,087 A 10/1953 Bliss
2,718,854 A * 9/1955 Michaelis ..... 432/120
2,825,481 A 6/1956 Glenny
2,758,455 A 8/1956 Anderson
2,950,825 A 12/1958 Averill
3,106,202 A 1/1959 Arduna
D189,311 S 11/1960 Kurt
3,012,554 A 12/1961 Hirsch
3,164,108 A 12/1961 Romero
3,169,641 A 4/1962 Chapman
3,145,850 A 1/1963 Ciborowski
3,288,303 A 8/1964 Dahl
3,396,885 A 2/1967 Leona
3,371,796 A 3/1968 Crouch
3,545,624 A 12/1970 Krikorian
3,613,970 A 10/1971 Humlong
3,647,077 A 3/1972 Gillespie
3,695,496 A 10/1972 Humlong
3,730,108 A 5/1973 Stroh
3,923,187 A 12/1975 Johansson et al.
3,977,389 A * 8/1976 Ondrasik, II ..... 126/337 R
3,977,529 A 8/1976 Stroh
3,993,002 A 11/1976 Stroh
D253,685 S 12/1979 Chapman
4,210,072 A * 7/1980 Pedrini ..... 99/340
4,269,336 A 5/1981 Humlong
4,331,270 A 5/1982 Humlong
D268,878 S 5/1983 Taylor
4,625,098 A * 11/1986 Joe ..... 219/450.1
4,640,265 A 2/1987 Romo
4,706,832 A * 11/1987 Citino ..... 99/447
4,739,154 A 4/1988 Bharara et al.
D296,601 S 7/1988 Chap
5,230,554 A 7/1993 Camilleri
5,330,063 A 7/1994 Remmers
5,365,833 A 11/1994 Chen
5,810,179 A 9/1998 Kleinan
6,041,769 A 3/2000 Llodra, Jr. et al.
D426,749 S * 6/2000 Barnes et al. ..... D7/409
6,097,004 A 8/2000 Seul
6,112,916 A 9/2000 Barnes et al.
6,148,813 A 11/2000 Barnes et al.
6,205,997 B1 3/2001 Bartley
D444,012 S 6/2001 Ferrer Baltran
6,307,185 B1 10/2001 Loveless
6,337,466 B1 1/2002 Chasen
6,425,388 B1 7/2002 Korinchock
D464,516 S 10/2002 Snell
6,467,860 B2 10/2002 Remmers
6,547,080 B1 4/2003 Guard
6,578,720 B1 6/2003 Wang
D479,663 S 9/2003 Snell
6,640,695 B2 11/2003 Stark
6,644,302 B1 11/2003 Bartley
D490,645 S 6/2004 Firlotte
6,745,578 B2 6/2004 Collins et al.
D508,821 S 8/2005 Freese
6,926,001 B2 * 8/2005 Bartley ..... 126/337 R
D509,103 S 9/2005 Shin
D509,405 S 9/2005 Shin
D509,706 S 9/2005 Shin
6,938,617 B2 * 9/2005 Le et al. ..... 126/339
D510,839 S * 10/2005 Shin ..... D7/409
7,087,862 B1 8/2006 Shaffer et al.
7,347,198 B2 * 3/2008 Freese et al. ..... 126/337 R
7,372,000 B2 * 5/2008 Stockley ..... 219/400
7,472,796 B2 * 1/2009 Dunn ..... 211/153
7,703,453 B2 * 4/2010 Hughes ..... 126/339
7,954,424 B2 * 6/2011 Dunn et al. ..... 99/426
2004/0094143 A1 5/2004 Bartley
2005/0204933 A1 * 9/2005 Freese et al. ..... 99/450
2005/0218097 A1 * 10/2005 Dunn ..... 211/153
2007/0137501 A1 * 6/2007 Manuel ..... 99/450
2008/0295703 A1 * 12/2008 Chen ..... 99/340

* cited by examiner

BAKING STONE RACK

RELATED APPLICATIONS

This application is a continuation of U.S. application Ser. No. 11/466,514 filed on Aug. 23, 2006. This application is incorporated herein by reference.

FIELD OF THE INVENTION

The present invention relates to racks for appliances, and more particularly, to a baking stone rack for an oven.

BACKGROUND OF THE INVENTION

Appliances, such as ovens, often have one or more racks generally within the appliance. For example, the racks can be useful for the placing of cookware, food, and other items, within the oven. The racks can place the cookware generally towards the middle of the oven, and can keep the cookware away from heating elements and the like. In addition, ovens with multiple racks allow for placement of cookware on a variety of levels within the oven, thereby increasing the total volume of available cooking.

The racks are often supported by ledges formed along the inner walls of the oven. The racks are then movable in and out of the oven on the ledges. This allows the racks to be removed from the oven for cleaning or for other purposes. Often, the racks may be partially removed from the oven so as to allow easier access to items placed on the racks. The ledges also facilitate vertical adjustment of the racks within the oven cavity.

Appliance racks, and specifically oven racks, are often of wire form construction. More specifically, an outer wire frame and a support platform, which is constituted by a plurality of fore-to-aft and laterally spaced wires, define a typical oven rack. The wires are generally evenly spaced across the entire rack for use in supporting food items to be cooked.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, a rack for an appliance comprises a main section including a support frame having a front wire, rear wire, and opposed side wires. A plurality of intermediate wires are attached to the support frame and at least one cross member is provided across a portion of the intermediate wires. The rack also includes a recessed section defined by a portion of the intermediate wires and adapted to removably receive a baking stone.

In accordance with another aspect of the present invention, a rack for an appliance comprises a main section including a first platform area and a support frame. A plurality of intermediate wires are attached to the support frame. A recessed section has a depth sufficient to accommodate a baking stone substantially completely therein and includes a second platform area. At least one strengthening member is provided across a portion of the second platform area.

In accordance with another aspect of the present invention, an arrangement for supporting items within an appliance comprises a rack including a main section having a support frame and a plurality of intermediate wires attached to the support frame. A recessed section is defined by a portion of the intermediate wires, and at least one strengthening member is provided across a portion of the intermediate wires. A baking stone adapted to be received substantially completely within the recessed section of the rack.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF AN EXAMPLE EMBODIMENT

Figure 1:
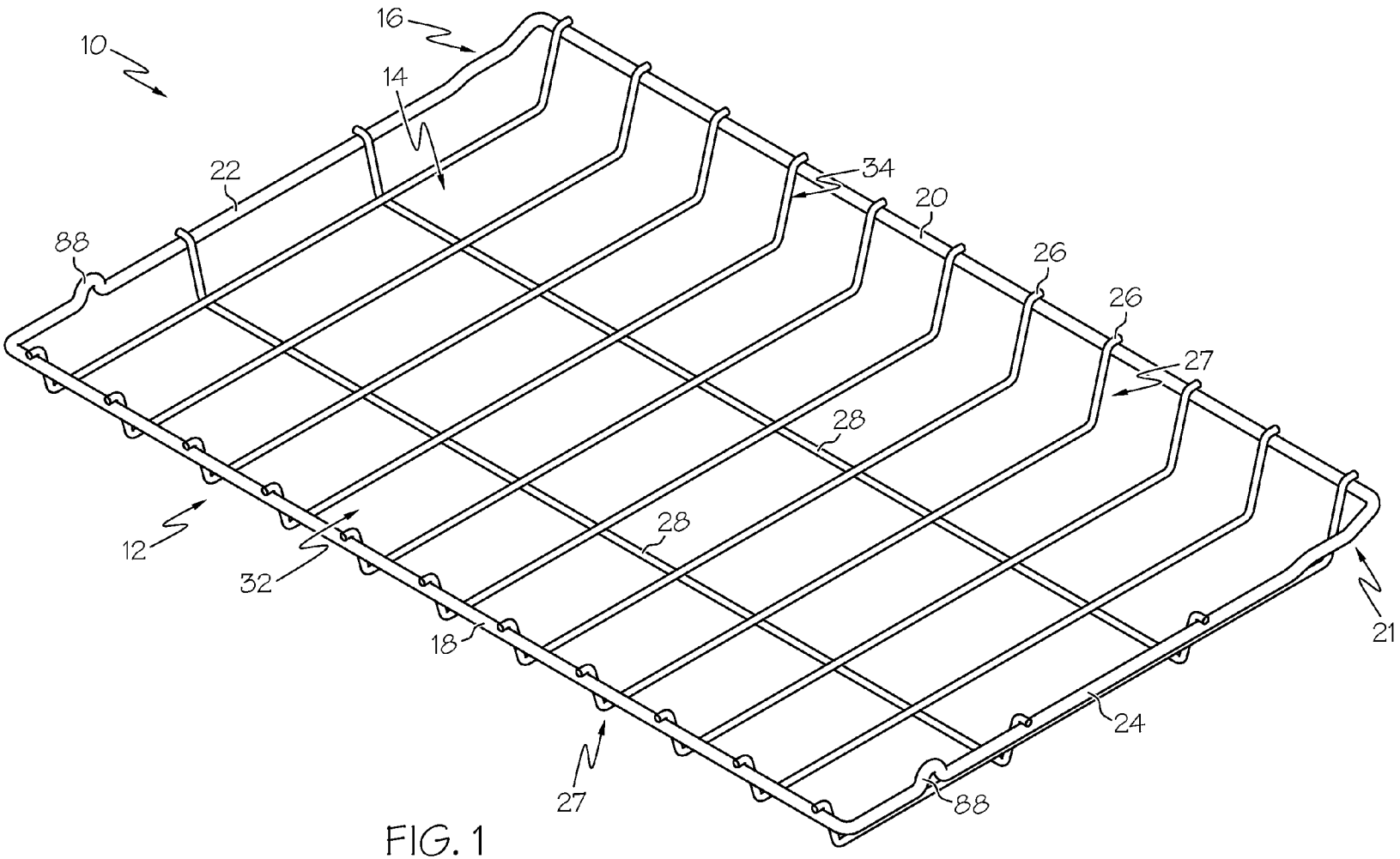
FIG. 1 illustrates a perspective view of an example baking stone rack in accordance with an aspect of the present invention.

An example embodiment of a rack that incorporates aspects of the present invention is shown in the drawings. It is to be appreciated that the shown example is not intended to be a limitation on the present invention. For example, one or more aspects of the present invention can be utilized in other embodiments and even other types of racks.

Turning to the shown example of FIG. 1, an example of a baking stone rack 10 for an appliance, such as an oven, is illustrated in accordance with an aspect of the present invention. The baking stone rack 10 includes a main section 12 and a recessed section 14. Both the main section 12 and the recessed section 14 can be constructed from metal wire, such as iron coated with nickel or steel coated with porcelain. However, it is to be appreciated that the main section 12 and the recessed section 14 can be constructed from various other suitable materials (e.g., various other metals and/or sheet metal).

The main section 12 can include a support frame 16. For example, the support frame 16 can include a front wire 18, a rear wire 20, and opposed side wires 22, 24. The front wire 18, rear wire 20, and side wires 22, 24 can be attached together to form the support frame 16 in various manners, such as by welding, adhesives, or fasteners, and/or can even be formed from a single piece of wire. As shown, the support frame 16 can have a generally rectangular geometry, through it is to be appreciated that the support frame 16 can have various other geometries. Additionally, a portion of the frame 16, such as the rear wire 20, can include an upwardly extending portion 21 that is adapted to engage structure (e.g., downward-facing projection 90, see FIG. 8) of an appliance to inhibit the rack from being removed therefrom.

A plurality of intermediate wires 26 can be attached to the support frame 16, and at least one cross member 28 or strengthening member can be provided across a portion of the intermediate wires 26. For example, as shown, the plurality of intermediate wires 26 can extend between the front and rear wires 18, 20 and along a transverse axis of the main section 12, while two cross members 28 can be provided across the intermediate wires 26 and can extend along a longitudinal axis of the main section 12. The intermediate wires 26 can be welded, or otherwise secured, to the support frame 16. In addition or alternatively, the cross members 28 can also be welded or otherwise secured to the side wires 22, 24. Further still, the cross members 28 can be welded or otherwise secured to the intermediate wires 26. It is to be appreciated that the intermediate wires 26 and/or the cross members 28 can extend between any of the front, rear, or side wires 18, 20, 22, 24 and can be oriented at various angles relative to each other and/or the support frame 16. The intermediate wires 26 and cross members 28 can be manufactured from metal wire or various other suitable materials that provide adequate strength to support various items such as cake pans, baking stones, casseroles, or the like, and can withstand the heat of an oven.

Figure 3:
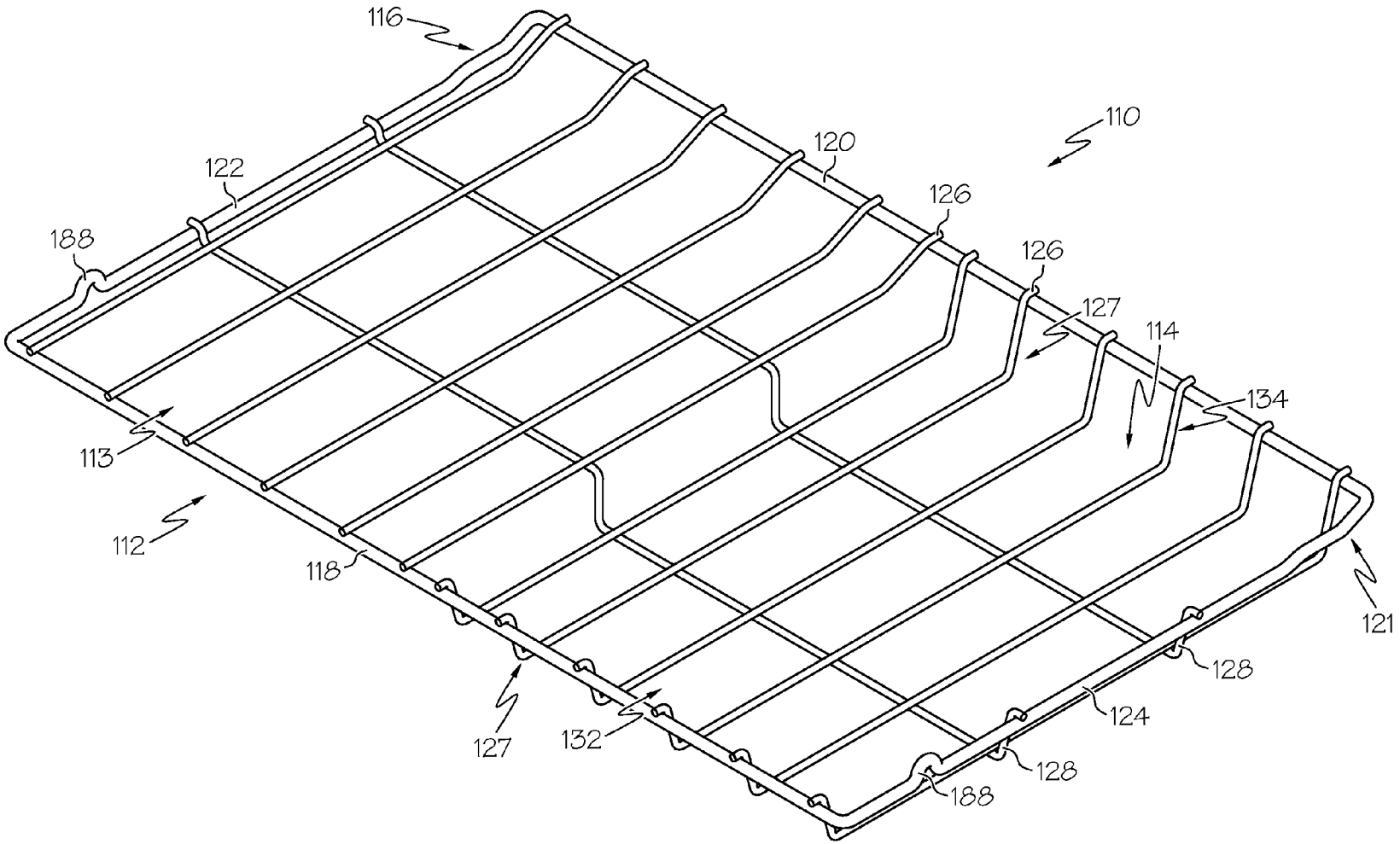
FIG. 3 illustrates a perspective view of another example backing stone rack in accordance with another aspect of the present invention.
Figure 4:
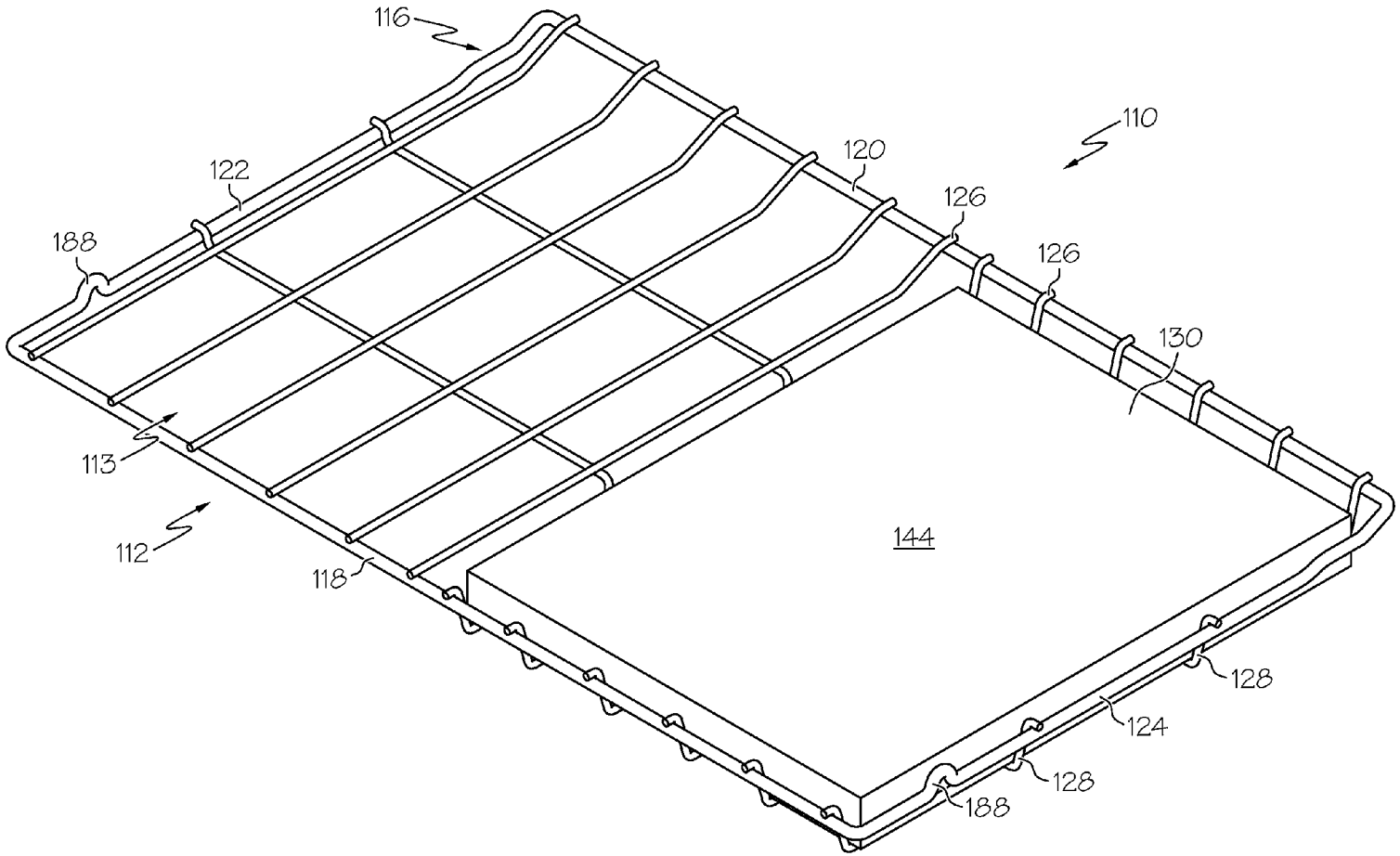
FIG. 4 illustrates the baking stone rack of FIG. 3 having an example baking stone received thereby in accordance with an aspect of the present invention.
Figure 5:
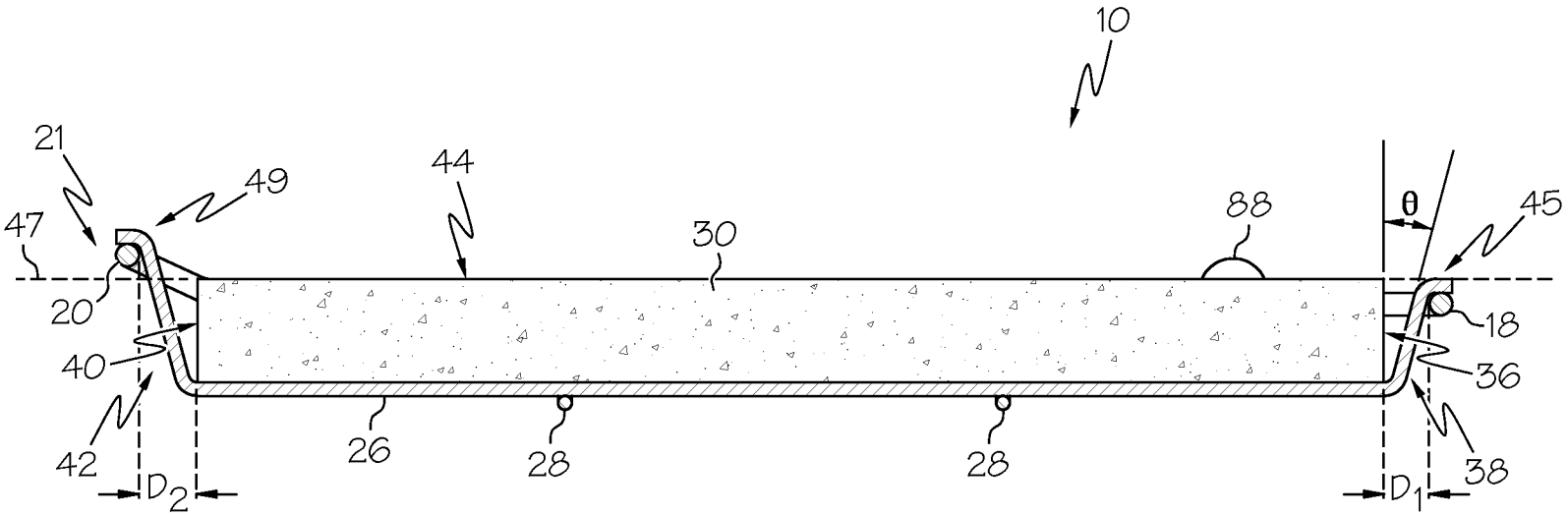
FIG. 5 illustrates a sectional view along line 5-5 of FIG. 2 of the baking stone rack.

As stated above, the rack 10 can include a recessed section 14 defined by a portion of the intermediate wires 26. For example, some or all of the intermediate wires 26 can include downwardly depending portions 27 that form the recessed section 14 within a central portion of the rack 10. As shown in FIG. 5, for example, the downwardly depending portions 27 can be configured to provide the recessed portion 14 with a depth sufficient to accommodate a baking stone 30 completely therein. In addition, the recessed section 14 can occupy a relatively large portion of the rack 10, though it is to be appreciated that various relative sizes of the main and recessed sections 12, 14 are possible, as shown in FIGS. 3 and 4.

Figure 2:
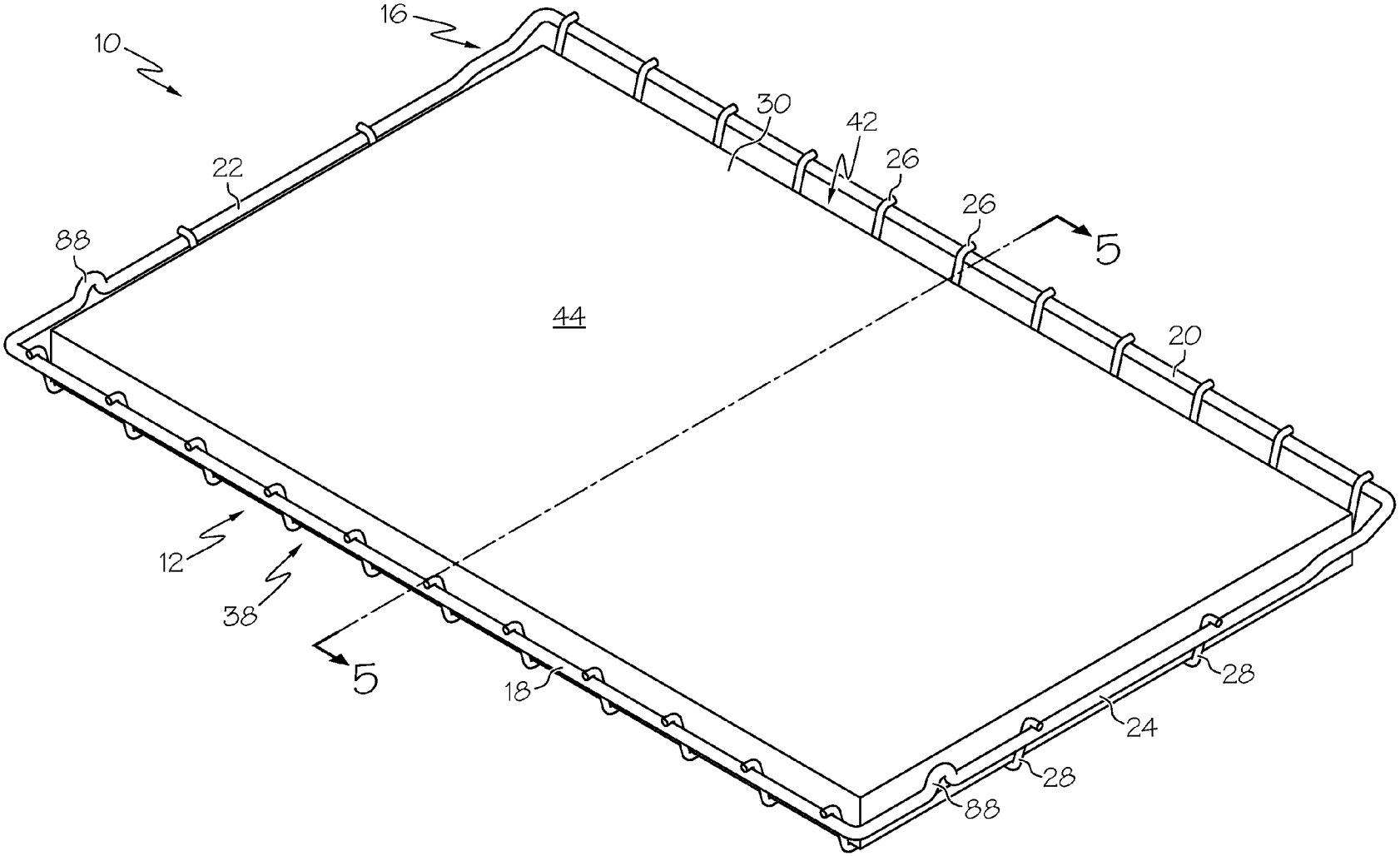
FIG. 2 illustrates the baking stone rack of FIG. 1 having an example baking stone received thereby in accordance with an aspect of the present invention.

Turning now to FIG. 2, the recessed section 14 can be adapted to removably receive a baking stone 30. For example, as shown, the recessed section 14 can be configured to receive a baking stone 30 having a generally rectangular geometry. In addition or alternatively, the recessed portion 14 can be configured to include various other geometries, such as, for example, square, triangular, polygonal, circular, oval and/or elliptical. It is to be appreciated that the recessed section 14 can also be configured to receive a plurality of baking stones 30 (see FIG. 8), and/or the rack 10 can even include a plurality of recessed sections 14 (not shown).

Further still, at least one of the intermediate wires 26 can include a ramped portion 34 adapted to facilitate removal of the baking stone 30 from the recessed section 14 (e.g., for cleaning, replacement, or other purposes). For example, as shown in FIG. 1, a plurality of the intermediate wires 26 can include ramped portions 34. As such, the intermediate wires 26 can be oriented at an angle θ (see FIG. 5) relative to the baking stone 30 to assist in removing the baking stone 30 from the recessed section 14. In one example, the angle θ might be approximately 15°, though various other angles are contemplated to be within the scope of the invention. In addition or alternatively, some or all of the intermediate wires 26 can include stepped portions (not shown).

Even further still, the recessed section 14 can be spaced a distance from the support frame 16. For example, the recessed section 14 can be spaced a respective distance from each of the front wire 18, rear wire 20, and the side wires 22, 24. The respective spacings can define an air gap between the support frame 16 and the baking stone 30 to facilitate the conduction of heat to, and the convection of hot gasses around, the baking stone 30 and/or any items supported thereon for cooking in an oven. As shown in FIG. 5, for example, a first edge 36 of the baking stone 30 can be disposed a first distance $D_1$ from the front wire 18 to form a first air gap 38 therebetween. A second edge 40 of the baking stone 30 can also be disposed a second distance $D_2$ from the rear wire 20 to form a second air gap 42 therebetween. Similarly, the baking stone 30 can be spaced various distances from each of the side wires 22, 24. In one example, each of the respective distances can be equal (e.g., $D_1$ can be approximately equal to $D_2$), though it is to be appreciated that each of the respective distances can have various values relative to each other.

Returning briefly to FIG. 1, the recessed section 14 can include a support area 32 or platform area defined by the intermediate wires 26. The support area 32 can have a generally planar geometry so as to provide an area configured to support various items. For example, as shown in FIG. 2, the support area 32 can support the baking stone 30. In addition or alternatively, the support area 32 can be adapted to support various other items, independent of whether a baking stone 30 is received within the recessed section 14. For example, the support area 32 can support cake pans, cookie sheets, and/or casseroles. As such, the cross members 28 can be provided across a portion of the support area 32 to mitigate sagging of the support area 32 when heavy food, cookware, or the like is placed thereon.

Turning now to the examples shown in FIGS. 3 and 4, another example baking stone rack 110 is illustrated in accordance with another aspect of the present invention. The baking stone rack 110 can also include a main section 112 and a recessed section 114 constructed from metal wire, as previously discussed herein. The main section 112 can include a support frame 116 having a front wire 118, a rear wire 120, and opposed side wires 122, 124 attached thereto and/or formed from a single piece of wire. The frame 116 can include an upwardly extending portion 121. A plurality of intermediate wires 126 can be attached to the support frame 116, and at least one cross member 128 or strengthening member can be provided across a portion of the intermediate wires 126. As before, the intermediate wires 126 and/or the cross members 128 can extend between any of the front, rear, or side wires 118, 120, 122, 124 and can be oriented at various angles relative to each other and/or the support frame 116. Further still, a portion of the intermediate wires 126 can form a first platform area 113 configured to support cookware, food, and/or other items within the oven. The support frame 116 can also include one or more upward facing projections 188.

Additionally, the rack 110 can include a recessed section 114 defined by a portion of the intermediate wires 126 and downwardly depending portions 127 configured to provide the recessed portion 114 with a depth sufficient to accommodate a baking stone 130 completely therein. The recessed section 114 can include a second platform area 132 defined by a portion of the intermediate wires 126 that is configured to support various items, such as the baking stone 130. As shown, the main section 112 can occupy approximately half of the rack 110, while the recessed portion 114 can occupy the remaining half of the rack 110. Further still, as shown, the baking stone 130 can include a support surface 144 that can be generally co-planar to the first platform area 113 when the baking stone 130 is received within the recessed section 114. Thus, a relatively large item, such as a cookie sheet or casserole dish (not shown), can be supported within the oven cavity simultaneously by both the first platform area 113 and the support surface 144 of the baking stone 130. Alternatively, the first platform area 113, second platform area 132, and/or the baking stone 130 can support various items independently.

It is to be appreciated that the baking stone 130 can include various geometries, such as, for example, rectangular, square, triangular, polygonal, circular, oval and/or elliptical. It is to be appreciated that the recessed section 114 can also be configured to receive a plurality of baking stones 130, and/or the rack 110 can even include a plurality of recessed sections 114 (not shown). Further still, at least one of the intermediate wires 126 can include a ramped portion 134 adapted to facilitate removal of the baking stone 130 from the recessed section 114 (e.g., for cleaning, replacement, or other purposes).

Figure 6:
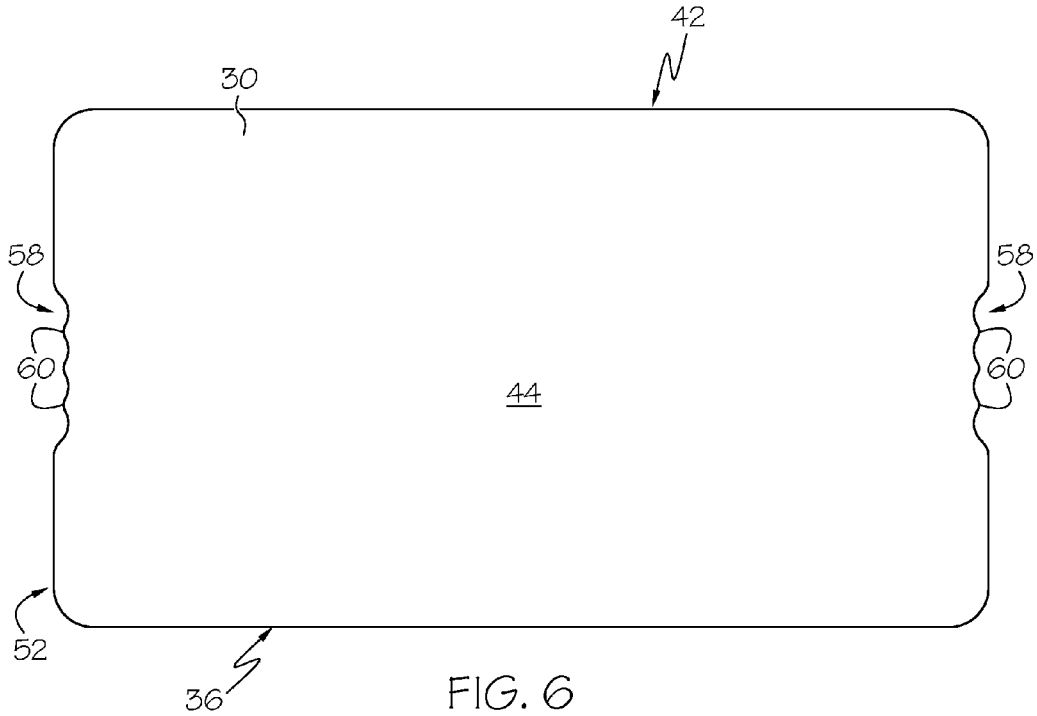
FIG. 6 illustrates a top view of the example baking stone.
Figure 7:
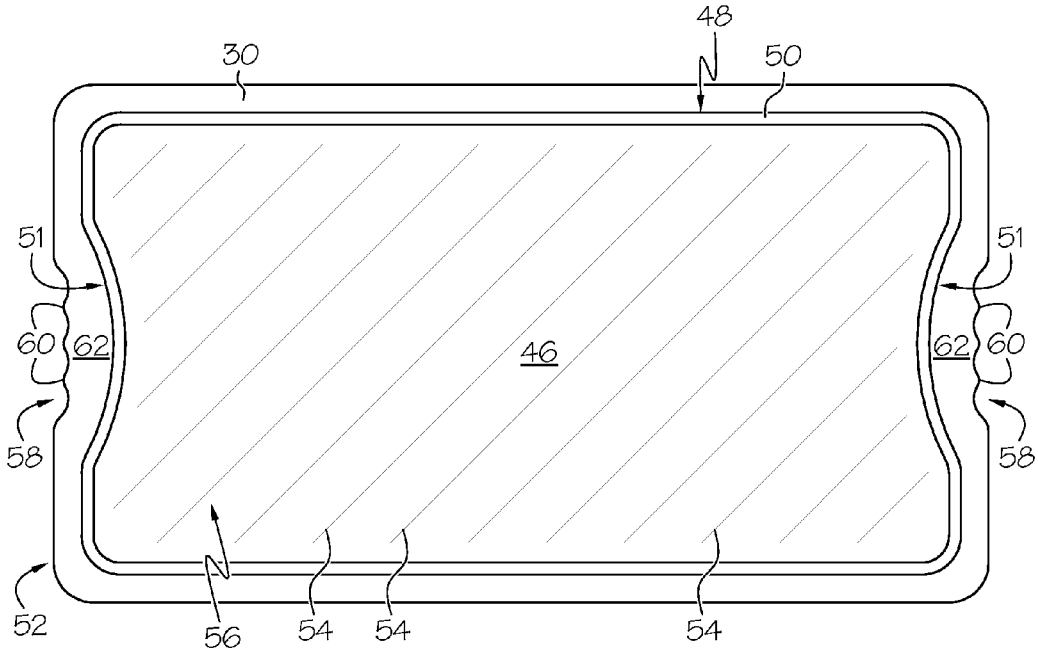
FIG. 7 illustrates a bottom view of the example baking stone.

Turning now to the examples shown in FIGS. 6 and 7, the baking stone rack 10 can be adapted to support an example baking stone 30. The baking stone 30 can include various types of baking stones having various sizes, geometries, materials, features, and/or performance characteristics. For example, the baking stone 30 can include a pizza stone adapted to bake pizzas, or a bread stone adapted to bake breads, pretzels, cakes, or the like. The baking stone 30 can include various materials, such as ceramics, clays, and/or firebrick. The baking stone 30 can also include various surface characteristics. For example, the baking stone can include various surface treatments, such as various coatings and/or glazings. In addition or alternatively, the exterior surface of the baking stone 30 can be relatively rough, relatively smooth, or any combination thereof. Accordingly, the following description of an example baking stone 30 is not intended to provide a limitation upon the present invention, and as such various other baking stones 30 can be used with the baking stone rack 10.

As shown, the baking stone 30 can have a generally rectangular geometry. Thus, the baking stone 30 can have a first support surface 44 and a second support surface 46. As shown, the first support surface 44 can have a generally planar geometry to enable various items to be supported by the baking stone 30. In addition or alternatively, the second support surface 46 can also have a generally planar geometry, though it is to be appreciated that either, or both, of the first and second support surfaces 44, 46 can include various other features, as will be discussed further herein. In one example, either or both of the support surfaces 44, 46 can include convex or concave geometry. Though the following features may be discussed with reference to either of the first or second support surfaces 44, 46, it is contemplated that any of the features, or any combination thereof, can be included on either, or both, of the support surfaces 44, 46.

As stated above, the recessed portion 14 can be configured to have a depth sufficient to accommodate a baking stone 30 completely therein. For example, as shown in FIG. 5, the main section 12 can include a platform area 45 such that the first support surface 44 of the baking stone 30 is generally co-planar to the platform area 45 (e.g., co-planar along plane line 47) when the baking stone 30 is received within the recessed section 14. Accordingly, the rack 10 can be adapted to support various items that are larger than the first support surface 44 of the baking stone 30. For example, the rack 10 can support a relatively large cookie sheet or the like (not shown) by supporting a portion of the cookie sheet on the platform area 45 and a portion of the first support surface 44. Additionally, as shown, the rear wire 20 of the support frame 16 can be located at a relatively higher position with respect to the front wire 18. As such, a portion of the intermediate wires 26 attached to the rear wire 20 can act as a stop 49 to limit the extent to which an item can be inserted into an oven cavity. In addition or alternatively, the main section 12 can include an additional platform area (not shown) located adjacent the rear wire 20 to provide support for even larger items.

In another example feature, as shown, the second support surface 46 can include a projection 48 extending therefrom. In one example, the projection 48 can comprise a lip portion 50 configured to inhibit items (e.g., items being cooked or residue therefrom, such as water, oils, sauces, or the like) from inadvertently leaving the second support surface 46. The lip portion 50 can have a geometry generally similar to an exterior perimeter 52 of the baking stone 30. Thus, as shown in FIG. 7, the lip portion 50 can have a generally rectangular geometry that is similar to the exterior perimeter 52 of the generally rectangular baking stone 30. It is to be appreciated that the lip portion 50 can have various other geometries, as well. For example, the lip portion 50 can include curved portions 51 or the like configured to provide additional spacing around various features of the baking stone 30, as will be discussed more fully herein. In addition or alternatively, the baking stone 30 can also include trough or the like (not shown) having a geometry similar to an exterior perimeter 52 of the baking stone 30 to thereby create a catch basin (not shown) for retaining residue, such as water, oils, or the like from items being cooked.

In another example, the projection 48 can extend from a more centralized area of the second support surface 46 to define specific cooking zones thereon (not shown). In yet another example, the projection 48 can comprise a plurality of projections 54 arranged in a pattern 56. For example, the plurality of projections 54 can extend from the second support surface 46 and can be arranged in a pattern 56 to provide various visual and/or performance characteristics with regard to items being cooked, such as for providing "grill marks" or the like. Further still, the plurality of projections 54 can extend from the second support surface 46 and can be configured to provide various performance characteristics with regard to the baking stone 30, such as providing various heat transfer zones and/or strengthening support ribs (not shown). Even further still, the plurality of projections 54 can provide structural characteristics for the baking stone 30. In one example, the projections 54 can act as support ribs to inhibit flexure or the like of the baking stone 30. It is to be appreciated that various numbers of projections 54 can have various sizes and geometries, and can be arranged in various other manners, patterns, arrays, and/or even randomly. It is also to be appreciated that the plurality of projections 54 can be separated a distance from each other, may be connected to each other, and/or may even be connected to the lip portion 50.

The baking stone 30 can further include other features. For example, the baking stone 30 can include at least one grip portion 58 adapted to be grasped by a hand of a user (not shown). For example, as shown, the baking stone 30 can include a pair of opposed grip portions 58 disposed on opposite sides thereof. The grip portions 58 can provide recessed areas adapted to assist the removal of the baking stone 30 from the recessed section 14. The grip portions 58 can include various features, such as finger grips 60 adapted to receive the fingers of a user's hand. In addition or alternatively, as shown in FIG. 7, the grip portions 58 can cooperate with a projection 48, such as the lip portion 50, to provide a grip surface 62. It is to be appreciated that various numbers of grip portions 58 can include various features and can be disposed at various locations on the baking stone 30.

Figure 8:
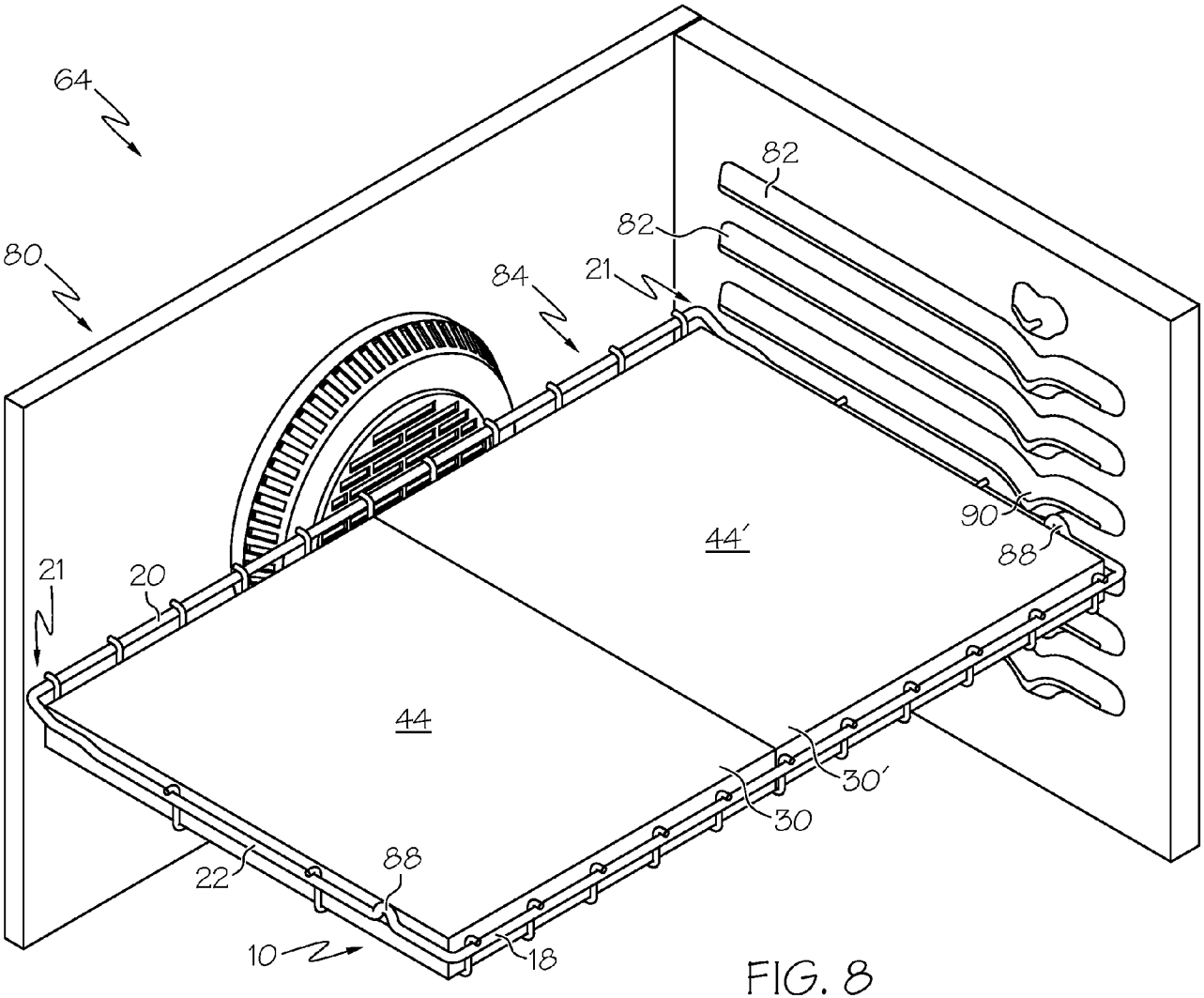
FIG. 8 illustrates a perspective view of the baking stone rack in an oven environment in accordance with an aspect of the present invention.

Turning now to FIG. 8, an arrangement 64 for supporting items within an appliance is illustrated. As shown, the baking stone rack 10 of the present invention is illustrated employed within an oven environment 80. Thus, as shown, the support frame 16 of the main section 12 can be supported by guide rails 82 within an oven cavity 84. As shown in FIG. 1, the main section 12 can include an upward-facing projection 88 integrally formed in the wire frame of each of the sides 22, 24 of the support frame 16 to facilitate alignment of the rack 10 within the oven 80. As shown, the guide rails 82 of the oven 80 can have corresponding downward-facing projections 90. Specifically, the upward-facing projections 88 of the main section 12 can be adapted to contact the downward-facing projections 90 of the top guide rails 82 such that a stop is created to properly align the main section 12 within the standard rack location of the oven 80.

Accordingly, with the baking stone rack 10 supported within the oven cavity 84, the platform area 45 of the main section 12 and the first support surface 44 of the baking stone 30 can be utilized to support various items for cooking within the oven. Further, as shown, the rack 10 can receive a plurality of baking stones 30, 30' each having a support surface 44, 44'. In addition or alternatively, various items can also be supported on other oven racks (not shown) simultaneously without the need to add or remove any other racks.

It is to be appreciated that the racks of the subject invention can be used in settings other than in an oven. For example, the racks of the subject invention could be used in a refrigerator and/or freezer unit. Further, it is to be appreciated that the racks can be constructed of any suitable material, such as metal, plastic, and the like. Further still, the frame, the bars, and the cross-member(s) need not be constructed from the same materials.

The size of the frame of the rack of the subject invention also depends upon the intended use of the rack. In the example embodiments, the rack is sized to slide into or replace a rack of a conventional oven. Likewise, the bars are spaced to accommodate cookware. The frame can be made larger to fit commercial ovens or sized to fit any apparatus in which the racks are to be used. The bars of the rack can be spaced appropriately within the frame to hold any designated item.

The invention has been described with reference to various example embodiments. Obviously, modifications and alterations will occur to others upon a reading and understanding of this specification. It is intended to include all such modifications and alterations insofar as they come within the scope of the appended claims or the equivalents thereof.

What is claimed is:

1. A baking stone and rack combination for an appliance comprising;

a main section including a support frame having a frontmost wire portion, a rearmost wire portion, and opposed outermost side wire portions, the outermost side wire portions each including an upward-facing projection located generally towards the frontmost wire portion and an upwardly extending portion located generally towards the rearmost wire portion such that the rearmost wire portion is located at a higher position with respect to the frontmost wire portion, wherein the outermost side wire portions are configured for sliding engagement along a top portion of at least two guide rails provided on opposing sidewalls in the appliance for supporting the main section, the main section further including:

a plurality of intermediate wires including a pair of downwardly depending portions attached to the frontmost wire portion of the support frame and the rearmost wire portion of the support frame, respectively, and at least one cross member including a pair of downwardly depending portions attached to the opposed outermost side wire portions of the support frame, respectively, and provided across a portion of the intermediate wires; and a recessed section located vertically below each of the frontmost wire portion, rearmost wire portion, and opposed outermost wire portions and defined by a portion of the intermediate wires that is located generally between the pair of downwardly depending portions thereof, and a baking stone dimensioned so as to be received within the recessed section, wherein the main section includes a first platform area and wherein the baking stone includes a support surface that is co-planar to the first platform area when the baking stone is received within the recessed section.

2. A baking stone and rack combination for an appliance comprising;

a rack including:

a main section including a support frame having a frontmost wire portion, a rearmost wire portion, and opposed outermost side wire portions, the outermost side wire portions each configured for sliding engagement along a top portion of at least two guide rails provided on opposing sidewalls in the appliance for supporting the rack, wherein the outermost side wire portions each include an upwardly extending portion that is configured to engage a corresponding structure in the appliance to inhibit the rack from being removed therefrom, and a recessed section including a plurality of intermediate wires each having a pair of downwardly depending portions attached to the frontmost wire portion of the support frame and the rearmost wire portion of the support frame, respectively, to define a platform area located vertically below each of the frontmost wire portion, a rearmost wire portion, and opposed outermost wire portions and generally between the pair of downwardly depending portions thereof, wherein at least one strengthening member is provided across a portion of the platform area, and a baking stone having a support surface for receiving food items thereon and a bottom surface opposite the support surface, wherein the baking stone includes a height that corresponds with a depth of the recessed section such that when positioned within the recessed section, the bottom surface of the baking stone is in direct contact with the rack and the support surface of the baking stone is coplanar with at least the frontmost wire portion.

3. The baking stone and rack combination of claim 2, wherein at least one of the downwardly depending portions of at least one of the plurality of intermediate wires includes a ramped geometry adapted to facilitate removal of the baking stone from the recessed section.

4. A baking stone and rack combination for an appliance comprising;

a rack including:

a main section including a support frame having a frontmost wire portion, a rearmost wire portion, and opposed outermost side wire portions, the outermost side wire portions each configured for sliding engagement along a top portion of at least two guide rails provided on opposing sidewalls in the appliance for supporting the rack, wherein the rearmost wire portion is located at a higher position with respect to each of the opposed outermost wire portions, and a recessed section including a plurality of intermediate wires each having a pair of downwardly depending portions attached to the frontmost wire portion of the support frame and the rearmost wire portion of the support frame, respectively, to define a platform area located vertically below each of the frontmost wire portion, a rearmost wire portion, and opposed outermost wire portions and generally between the pair of downwardly depending portions thereof, wherein at least one strengthening member is provided across a portion of the platform area, and a baking stone having a support surface for receiving food items thereon and a bottom surface opposite the support surface, wherein the baking stone includes a height that corresponds with a depth of the recessed section such that when positioned within the recessed section, the bottom surface of the baking stone is in direct contact with the rack and the support surface of the baking stone is coplanar with at least the frontmost wire portion.

* * * * *